United States Patent [19]

Hörmann

[11] Patent Number: 4,718,472

[45] Date of Patent: Jan. 12, 1988

[54] SECTIONAL STRIP FOR ROLL-UP, FOLD-UP, AND SIMILAR GATES

[75] Inventor: Michael Hörmann, Steinhagen, Fed. Rep. of Germany

[73] Assignee: Hörmann KG Amshausen, Steinhagen, Fed. Rep. of Germany

[21] Appl. No.: 5,343

[22] Filed: Jan. 13, 1987

Related U.S. Application Data

[63] Continuation of Ser. No. 750,901, Jul. 1, 1985, abandoned.

[30] Foreign Application Priority Data

Jul. 11, 1984 [DE] Fed. Rep. of Germany ..... 3425556

[51] Int. Cl.[4] ..... E06B 9/14

[52] U.S. Cl. ..... 160/229 R; 160/236

[58] Field of Search ..... 160/232, 233, 234, 235, 160/236, 229 R

[56] References Cited

U.S. PATENT DOCUMENTS

| | | | |
|---|---|---|---|
| 3,359,594 | 12/1967 | Pastoor | 160/235 X |
| 3,772,129 | 11/1973 | Dover | 160/236 X |
| 4,343,340 | 8/1982 | Paule | 160/232 |
| 4,436,136 | 3/1984 | Downey | 160/236 X |

FOREIGN PATENT DOCUMENTS

| | | | |
|---|---|---|---|
| 2109838 | 9/1972 | Fed. Rep. of Germany | 160/236 |
| 2720175 | 11/1978 | Fed. Rep. of Germany | 160/235 |
| 2098537 | 3/1972 | France | 160/232 |
| 2341729 | 9/1977 | France | 160/232 |
| 2105396 | 3/1983 | United Kingdom | 160/229 R |

*Primary Examiner*—Ramon S. Britts
*Assistant Examiner*—David M. Purol
*Attorney, Agent, or Firm*—Max Fogiel

[57] ABSTRACT

A sectional strip 5 with an outward-facing outside 10 and an inside 11 for roll-up, fold-up, and similar gates exhibits at its top 6 and bottom 7 a point of articulation 8 that extends over the total width of the gate for pivoting the adjacent upper and lower, identically shaped sectional strip in relation to the plane of the gate, which consists of the sectional strips that are not rolled up, when rolled up onto the armor of rolled-up sectional strips. The point 8 of articulation at top 6 is in the form of at least one perpendicular cylindrical sector 12 with an outward-facing surface 13 and the point 8 of articulation at bottom 7 is in the form of at least one cylindrical sector 14 with an inward-facing surface 15. The surface at top 6 and the surface at bottom 7 have radii 16 and 17 of curvature that are practically equal in length. The centers 18 and 19 of curvature of the radii of curvature of the surface at top 6 and of the surface at bottom 7 are located on a straight line and are at an equal perpendicular distance from the plane 23 of the gate, which is constituted by the outsides 10 of the sectional strips 5, with both straight lines coinciding with the axis of articulation of ech point 8 and 9 of articulation. The distance of the straight lines from the outside 10 is less than that to the inside 11.

18 Claims, 4 Drawing Figures

SECTIONAL STRIP FOR ROLL-UP, FOLD-UP, AND SIMILAR GATES

This application is a continuation of application Ser. No. 750,901, filed July 1, 1985, now abandoned.

The invention concerns a sectional strip with a point of articulation in accordance with the preamble to the major claim.

Sectional strips of this type are known in many embodiments. All sectional strips entail the problem of not being tight enough at their points of articulation. Furthermore, a series of increasingly wider gaps occurs at the transition from the plane of the gate to the armor between each strip and the immediately lower strip, which is still within the plane of the gate, as the strips are rolled up. The outer layer of sectional strips in the rolled-up armor likewise exhibits this wide gap, and leaves, twigs, and similar materials that arrive there as the result of powerful air currents can accumulate on it. The material in the gap can lead to malfunction or even in the worst case to complete destruction of the sectional strips when the armor is rolled down. Finally, the gaps constitute a safety hazard because the gap closes up at the transition from the plane of the gate to the armor and a hand or finger can easily get crushed in it. Since, however, even the sectional strips in the plane of the door exhibit a certain interplay, the gaps in that area will be rectangular in cross-section, in contrast to the angular cross-section of the gaps in the rolled-up armor. This is also a source of latent danger.

The object of the invention is to design a sectional strip of the overall type that is not subject to malfunction and that will not be a safety hazard at its points of articulation.

This object is attained through the object of claim 1.

The geometry of the points of articulation and their position in the vicinity of the outside of the sectional strip results in accordance with the invention in no gap at the outside that foreign material can get into when the strips are rolled up on the armor and incur malfunction or even damage to the strip. The lack of a gap also completely rules out the safety hazard. Finally, there is even no play between the sectional strips in the plane of the gate, meaning that there is no relative motion between them because the two straight lines of the centers of curvature of the radii of curvature of both surfaces coincide with the axis of articulation of each point of articulation.

Practical embodiments and developments of the invention are characterized in the subsidiary claims.

Figure 1:
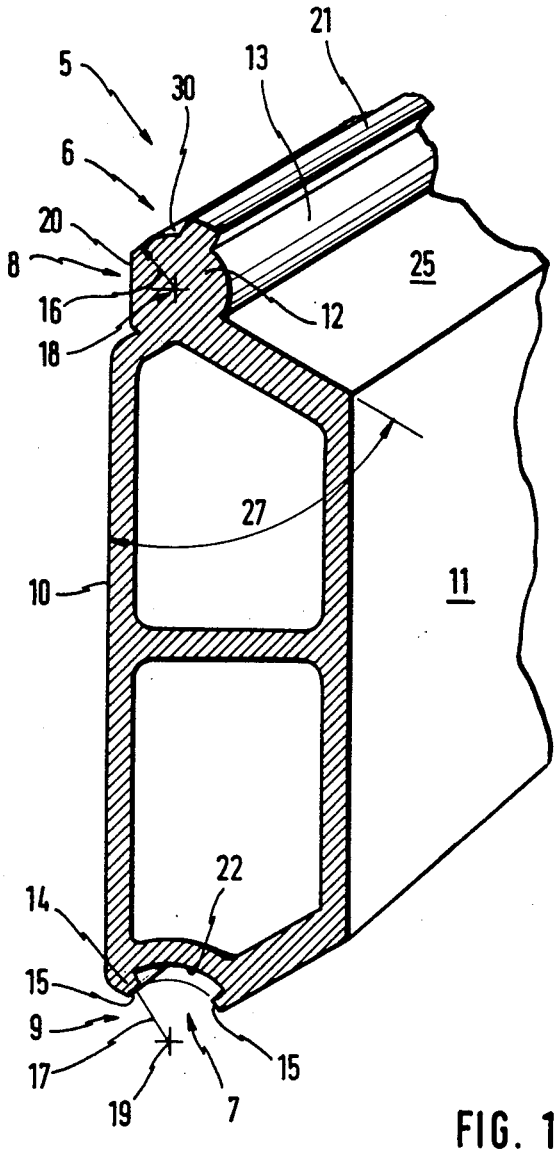
Figure 2:
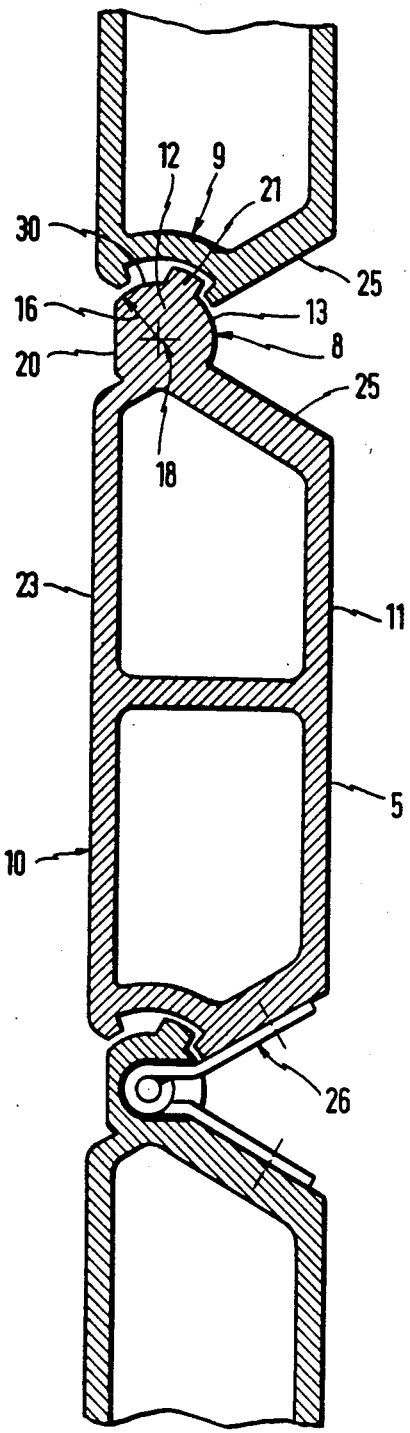
Figure 3:
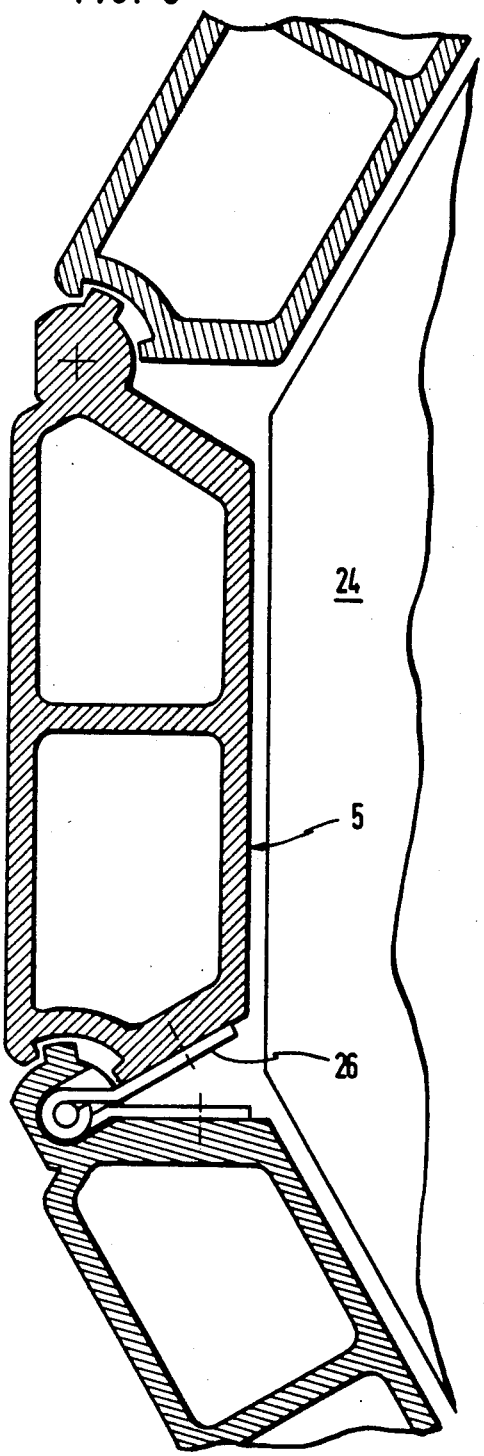
Figure 4:
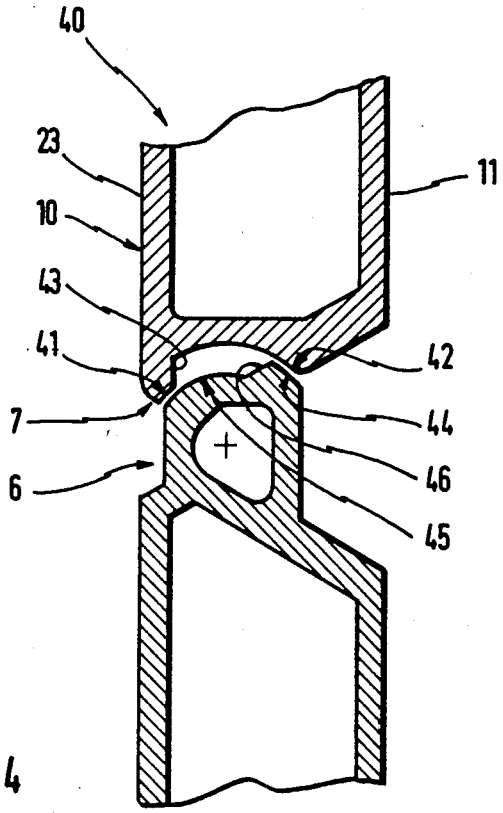

A preferred embodiment of the invention will now be described with reference to the drawings, in which FIG. 1 is a perspective section of a sectional strip, FIG. 2 is a schematic section through several sectional strips of the type illustrated in FIG. 1, linked together and located within the plane of the gate, FIG. 3 is a truncated cross-section through several strips of the type illustrated in FIG. 1, linked together and rolled up onto the armor, and FIG. 4 is a section through another embodiment of a sectional strip.

The sectional strip labeled 5 overall in FIG. 1 exhibits two points 8 and 9 of articulation extending over the total width of the door, one at the top 6 and the other at the bottom 7 respectively. Sectional strip 5 also exhibits an outside 10, which faces out, and an inside 11.

The point 8 of articulation at top 6 is in this case a vertical round cylinder 12 with a surface 13 that faces out. The point 9 of articulation at bottom 7 is likewise a cylindrical sector 12 with a surface 15 that faces in. The radius 16 of curvature of upper surface 13 and the radius 17 of curvature of lower surface 15 are the same length in this case. The centers 18 and 19 of curvature of upper and lower surfaces 13 and 15 respectively are at the same distance from the outside 10 of sectional strip 5. The two straight lines constituted by centers 18 and 19 of curvature coincide with the axis of articulation (cf. FIGS. 2 and 3) of points 8 and 9 of articulation respectively. The straight line is also nearer outside 10 than it is to inside 11.

The cylindrical sector 12 at upper point 8 of articulation has a flattening 20 that parallels the outside 10 of sectional strip 5 and is set back toward inside 11 by no more than radius 16 of curvature, which is about equal to half the thickness of a finger.

The cylindrical sector 12 at top 6 also has a cam 21 that projects beyond the plane of surface 13 and is also in the form of a cylindrical sector with a longer radius of curvature that coincides with the center 18 of curvature of radius 16 of curvature.

The point 9 of articulation at bottom 7 has an inward-facing surface 22 for the cam 21 on the adjacent lower sectional strip, not illustrated, with a radius of curvature that is longer than radius 17 of curvature, whereas its center of curvature coincides with the center 19 of curvature of radius 17 of curvature.

Cam 21 and inward-facing surface 22 determine the maximal angle between two adjacent sectional strips 5 as they are rolled up out of the plane 23 of the gate (FIG. 1), which consists of the outsides 10 of sectional strips 5, onto armor 24 (FIG. 3).

The area 25 adjacent to points 8 or 9 of articulation at top 6 and bottom 7 respectively is in the form of a level surface for mounting hinges 26, and includes in conjunction with the front an acute angle 27. The angles of the hinges can preferably be fastened to mounting surface 25 with screws, and that area is accordingly thicker. Hinges 26 are inserted in grooves milled into the cylindrical sector 12 of the point 8 of articulation at the top 6 of sectional strip 5. There are several hinges 26 distributed at intervals along the total width of sectional strip 5.

Between cam 21 and the flattening 20 on the upper cylindrical sector 12 of point 8 of articulation is an area 30 of cylindrical sector 12 that extends forward to the front 10 of sectional strip 5 and exhibits the same radius 16 of curvature and center 18 of curvature (FIG. 2). Area 30 exhibits a central angle that is no greater than that of the surface 13 of the outward-facing surface of the cylindrical sector 12 on the other side of cam 21. The latter area is more extensive because it must also accommodate the wing of hinges 26.

FIG. 4 illustrates an alternate embodiment. The bottom 7 of sectional strip 40 exhibits two concentric perpendicular cylindrical sectors 41 and 42 with different diameters and allowing for an offset 43. Furthermore, the top 6 of the next lower sectional strip 40 exhibits two concentric cylindrical sectors 44 and 45, allowing for an offset 46, both offsets functioning as stops or mating stops and determining the the maximum pivoting angle between two adjacent sectional strips.

There is, however, a space between the outside and the inside of the sectional strip in the vicinity of each point of articulation in both embodiments to serve as a wind screen and dust catcher in a practical way and manner in accordance with the teaching of the invention.

I claim:

1. A sectional strip with an outward-facing outside and an inside for roll-up and fold-up gates, comprising: a gate having a total width and forming a plane; means for pivoting adjacent upper and lower identically shaped sectional strips in relation to the plane of a gate; said sectional strip having a top articulation location and a bottom articulation location each articulation location extending over the total width of the gate for said pivoting; said gate comprising of sectional strips forming the gate plane when not rolled up and forming a rolled-up profile when rolled up onto armor of rolled-up sectional strips; said top articulation comprising at least one perpendicular sector with an outward facing surface; said bottom articulation comprising at least one cylindrical sector with an inward-facing surface; said top and bottom articulations having surfaces with radii of curvature that are substantially equal in length, said radii having centers of curvature located on two straight lines extending at equal perpendicular distances from the plane of the gate and along the width of the gate, said gate being comprised of outsides of the sectional strips; one of said two straight lines is associated with the top articulation location and the other of said two straight lines is associated with the bottom articulation location, said top articulation location having a pivoting axis coinciding with the straight line associated with said top articulation and said bottom articulation having a pivoting axis coinciding with the straight line associated with said bottom articulation; the distance of the straight lines from the outside being less than that to the inside, so that formation of gaps in the gate when rolled up or unrolled is prevented; a cam in said inward-facing surface, each articulation location of two concentric surface areas with a different radius of curvature that is substantially the same length for said two surface areas and with an outward-facing surface includes with the longer radius of curvature a central angle that is smaller than one with the shorter radius of curvature and is in the form of said cam, a surface having the longer radius of curvature comprising a recess being of an adjacent sectional strip with a central angle that is greater than one in relation to the shorter radius of curvature and forming a maximum angle at the articulation location when the sectional strips are rolled up out of the plane of the gate onto the armor.

2. A sectional strip as defined in claim 1, wherein said distances of said straight lines from the outside are smaller than those to the inside by a multiple.

3. A sectional strip as defined in claim 1, wherein said cylindrical sector has a flattened portion.

4. A sectional strip as defined in claim 3, wherein said flattened portion is substantially parallel to said outside of said sectional strip.

5. A sectional strip as defined in claim 4, wherein said flattened portion is set back by an amount corresponding to the maximum magnitude of the radius of curvature.

6. A sectional strip as defined in claim 5, wherein said flattened portion has a maximum setback corresponding to the magnitude of the radius of curvature.

7. A sectional strip as defined in claim 4, wherein said flattened portion has a setback corresponding to half the length of the radius of curvature.

8. A sectional strip as defined in claim 1, including an outward-facing cam at the articulation location with the outward-facing surface, said articulation location with the inward-facing surface having a recess for receiving said cam, said cam and said recess forming the maximum angle at an articulation location between two adjacent sectional strips during rolling up out of the plane of the gate onto the armor.

9. A sectional strip as defined in claim 1, wherein said inward-facing surface with the longer radius of curvature has a dimension allowing for maximum angle while the sectional strips are being rolled up out of the plane of the gate onto the armor, said dimension being at least equal to the central angle that equals part of the outward-facing surface of said cylindrical sector that extends forward to the outside of the sectional strip when decreased by the central angle of said cam.

10. A sectional strip as defined in claim 1, including hinges and wherein an area adjacent to the inside of the sectional strip at said articulation locations at the top and the bottom is in form of a surface for mounting hinges and includes an acute angle with said outside.

11. A sectional strip as defined in claim 10, wherein said hinges are positioned only at intervals along the width of the sectional strip.

12. A sectional strip as defined in claim 10, wherein an extended angle equals, when decreased by twice said acute angle, no more than a maximum angle occurring while sectional strips are being rolled up out of the plane of the gate onto the armor.

13. A sectional strip as defined in claim 1, wherein mutually equivalent radii of curvature are substantially equal in length and differ only by a substantially small amount of play.

14. A sectional strip as defined in claim 1, wherein said sectional strips are comprised of curved PVC foam plastic.

15. A sectional strip as defined in claim 10, wherein said hinges allow only pivoting motion between sectional strips while being rolled up out of the plane of the gate onto the armor.

16. A sectional strip as defined in claim 1, wherein double the radius of curvature does not exceed two centimeters.

17. A sectional strip with an outward-facing outside and an inside for roll-up and fold-up gates, comprising: a gate having a total width and forming a plane; means for pivoting adjacent upper and lower identically shaped sectional strips in relation to the plane of a gate; said sectional strip having a top articulation location and a bottom articulation location each articulation location extending over the total width of the gate for said pivoting; said gate comprising of sectional strips forming the gate plane when not rolled up and forming a rolled-up profile when rolled up onto armor of rolled-up sectional strips; said top articulation comprising at least one perpendicular sector with an outward facing surface; said bottom articulation comprising at least one cylindrical sector with an inward-facing surface; said top and bottom articulations having surfaces with radii of curvature that are substantially equal in length, said radii having centers of curvature located on two straight lines extending at equal perpendicular distances from the plane of the gate and along the width of the gate, said gate being comprised of outsides of the sectional strips; one of said two straight lines is associated with the top articulation location and the other of said two straight lines is associated with the bottom articulation location, said top articulation location having a pivoting axis coinciding with the straight line associated with said top articulation and said bottom articulation having a pivoting axis coinciding with the straight line associated with said bottom articulation; the distance of the straight lines from the outside being less than that to the inside, so that formation of gaps in the gate when rolled up or unrolled is prevented; said articulation location at the bottom having two concentric cylindrical sectors of different diameter with an inward-facing surface, surfaces at the top and at the bottom having substantially equal radii of curvature, centers of curvature of radii of curvature of the surface at said top and at said bottom of the sectional strip being located on straight lines at substantially equal perpendicular distances from the plane of the gate comprised of outside of sectional strips, said straight lines coinciding with an axis of articulation of each articulation location, distances of said straight lines from the outside being less than the distances to the inside.

18. A sectional strip as defined in claim 17, wherein said two cylindrical sectors have an offset therebetween at the bottom and comprising a stop cooperating with a mating stop, said mating stop comprising an offset between said two cylindrical sectors at the top of an adjacent lower sectional strip.

* * * * *